US006613386B1

(12) United States Patent
Kustermann

(10) Patent No.: US 6,613,386 B1
(45) Date of Patent: Sep. 2, 2003

(54) APPARATUS AND METHOD FOR DIRECT OR INDIRECT APPLICATION OF A LIQUID OR PASTY MEDIUM ONTO A TRAVELING MATERIAL WEB

(75) Inventor: Martin Kustermann, Heidenheim (DE)

(73) Assignee: Voit Sulzer Papiermaschinen GmbH, Heidenheim (DE)

( * ) Notice: Subject to any disclaimer, the term of this patent is extended or adjusted under 35 U.S.C. 154(b) by 793 days.

(21) Appl. No.: 09/012,508

(22) Filed: Jan. 23, 1998

(30) Foreign Application Priority Data

Jan. 24, 1997 (DE) ..... 197 02 605

(51) Int. Cl.[7] ..... B05D 3/00; B05C 11/00

(52) U.S. Cl. ..... 427/299; 427/356; 427/428; 118/50; 118/249; 118/410

(58) Field of Search ..... 427/356, 428, 427/299; 118/249, 50, 410

(56) References Cited

U.S. PATENT DOCUMENTS

| | | | | |
|---|---|---|---|---|
| 4,369,584 A | | 1/1983 | Daane | 34/12 |
| 4,491,283 A | * | 1/1985 | Pav et al. | 242/67.2 |
| 4,516,330 A | | 5/1985 | Eskelinen et al. | 34/23 |
| 4,665,631 A | | 5/1987 | Villalobos | 34/114 |
| 4,716,660 A | | 1/1988 | Thiele | 34/114 |
| 4,809,445 A | * | 3/1989 | Meyer et al. | 34/117 |
| 4,821,429 A | | 4/1989 | Sieberth | 34/114 |
| 4,856,205 A | * | 8/1989 | Meyer et al. | 34/117 |
| 4,880,671 A | | 11/1989 | Sollinger et al. | 427/356 |
| 4,893,741 A | | 1/1990 | Heinzmann | 226/196 |
| 5,291,666 A | | 3/1994 | Babinsky et al. | 34/18 |
| 5,340,402 A | | 8/1994 | Beisswanger | 118/410 |
| 5,370,735 A | | 12/1994 | Beisswanger | 118/249 |
| 5,474,608 A | * | 12/1995 | Beisswanger | 118/103 |
| 5,506,005 A | | 4/1996 | Paloviita | 427/428 |
| 5,830,275 A | | 11/1998 | Reich | 118/641 |

FOREIGN PATENT DOCUMENTS

| | | |
|---|---|---|
| DE | 32 20 074 A1 | 12/1983 |
| DE | 35 38 623 A1 | 5/1986 |
| DE | 42 05 313 C2 | 9/1994 |
| EP | 0 556 675 A1 | 2/1993 |

* cited by examiner

*Primary Examiner*—Katherine A. Bareford
(74) *Attorney, Agent, or Firm*—Taylor & Aust, P.C.

(57) ABSTRACT

An apparatus for direct or indirect application of a liquid or pasty medium onto a traveling material web includes at least one rotatable backing roll wrapped in part by the material web and supporting a side of the material web near the backing roll. The backing roll surface and the material web form a cuneiformly tapering entrance gore and an exit gore. At least one applicator opposes the backing roll and coats a side of the material web away from the backing roll with the medium, and/or further treats the coated material web side. A boundary layer stripper is arranged, in relation to the direction of rotation of the backing roll, before the applicator. The boundary layer stripper removes an air boundary layer entrained by the backing roll and/or the material web. The air boundary layer stripper is arranged in the entrance gore between the backing roll surface and the side of the material web near the backing roll.

8 Claims, 1 Drawing Sheet

APPARATUS AND METHOD FOR DIRECT OR INDIRECT APPLICATION OF A LIQUID OR PASTY MEDIUM ONTO A TRAVELING MATERIAL WEB

BACKGROUND OF THE INVENTION

1. Field of the Invention

The present invention relates to an apparatus for direct or indirect application of a liquid or pasty medium onto a traveling material web, notably of paper or cardboard. Furthermore, the invention relates to a method for direct or indirect application of a liquid or pasty medium onto such a material web.

2. Description of the Related Art

Apparatuses and methods for direct or indirect application of a liquid or pasty medium onto a traveling material web are typically used or applied in conjunction with so-called coating systems in order to coat one or both sides of a traveling material web. The web can include, for instance, paper, cardboard or a textile material. One or several layers of the medium, for example, color, starch, impregnating fluid or the like, are applied with an applicator.

In the so-called direct application, the liquid or pasty medium is applied by an applicator directly onto the surface of the traveling.material web. During application, the web is backed by a revolving counter surface, for example, an endless belt, or a counter roll or backing roll. In the indirect application of the medium, the liquid or pasty medium, in contrast, is first applied onto a substrate surface, for example, the surface of a backing roll configured as an applicator roll. The liquid or pasty medium is transferred from the applicator roll to the material web in a nip through which the material web passes.

A categorical apparatus for direct application of a liquid or pasty medium onto a traveling material web, notably of paper or cardboard, is known from German Document No. DE 42 05 313 A1, assigned to the assignee of the present invention. This apparatus includes a rotatable backing roll which in part is wrapped by the material web and supports a side of the material web facing the backing roll. The backing roll surface and the material web form a cuneiformly tapering entrance gore and an exit gore. Furthermore, the apparatus includes an applicator disposed opposite the backing roll and serving to coat a side of the material web away from the backing roll with the medium. A stripper removes a boundary layer of air entrained by the material web. The stripper is arranged, based on the direction of rotation of the backing roll, before the applicator. The air boundary layer stripper serves here to avoid disturbing effects of air in the entrance gore between the material web and the medium applied onto the material web. In other words, an undesirable air inclusion is avoided on the side of the material web on which the medium is applied, that is, on the side away from the backing roll.

Also known, from German Document No. EP 0 556 675 A1, assigned to the assignee of the present invention, is an apparatus comparable with that of the aforementioned German Document No. DE 42 05 313 A1, but for indirect application of a liquid or pasty coating color onto a traveling material web. This apparatus includes a roll applicator with an applicator roll rotating in a coating color sump or bath, as well as a backing roll disposed directly opposite the applicator roll and wrapped in part by a material web. The material web passes through the nip formed by the applicator roll and the backing roll, in which nip the coating color is transferred to the material web. Based on the direction of rotation of the backing roll, an air boundary layer stripper is arranged before the nip and in the cuneiform area formed by the contours of the opposing rolls. The stripper serves, the same as in German Document No. DE 42 05 313 A1, to avoid an undesirable air inclusion on the side of the material web on which the coating medium is applied.

Comparable with the apparatus according to German Document No. EP 0 556 675 A1 for indirect application of a liquid or pasty coating color onto a traveling material web, is a further apparatus disclosed in U.S. Patent Document No. 5,506,005. Instead of an air boundary layer stripper of the previously described type, however, this apparatus possesses a material web pressure system which, based on the direction of travel of the material web, is arranged behind the line of contact between the backing roll and the material web running onto the backing roll. That is, the material web pressure system is arranged behind the cuneiform entrance gore formed by the backing roll surface and the material web, and opposite the material web side away from the backing roll. The apparatus presses the material web onto the backing roll. For that purpose, an air jet is blown at a pressure of at least 2.5 kPa out of the material web pressure system and at the material web surface being coated. The material web pressure system serves to prevent an undesirable air inclusion between the backing roll surface and the material web side facing the backing roll.

With these conventional apparatuses and the associated method, however, it has been found that the air boundary layer entrained both by the material web and the backing roll can proceed easily between the backing roll surface and the material web. This causes the material web to form a bubble at the point of application or on a metering or treatment element preceding or succeeding the point of application. Such a bubble results in coating defects or wrinkles and, thus, in an appreciable impairment of the coating quality. Use of the prior material web pressure system has not, until now, been able to entirely solve this technical problem. It has been noted that, despite high contact pressures, undesirable air inclusions still proceed between the backing roll surface and the material web, specifically with varying material web properties and high web speeds.

SUMMARY OF THE INVENTION

The present invention further improves a categorical apparatus with respect to the previously illustrated difficulties of the air inclusions caused by air boundary layers, and thereby enables an increase in the achievable coating quality. The present invention also creates a suitable method for direct or indirect application of a liquid or pasty medium onto a traveling material web, which method extensively avoids the drawbacks associated with the prior art.

This apparatus for direct or indirect application of a liquid or pasty medium onto a traveling material web, notably of paper or cardboard, includes at least one rotatable backing roll which in part is wrapped by the material web and supports a side of the material web facing the backing roll. The backing roll surface and the material web form a cuneiformly tapering entrance gore and an exit gore. Moreover, the apparatus includes at least one applicator opposing the backing roll. The applicator serves to coat a material web side away from the backing roll with the medium and/or to further treat the coated material web side. The apparatus also includes at least one air boundary layer stripper serving to remove an air boundary layer entrained by the backing roll and/or the material web. The stripper is arranged before the applicator, based on the direction of rotation of the backing roll. The at least one air boundary layer stripper is arranged in the entrance gore between the backing roll surface and the material web side near the backing roll. To be understood as an applicator in the purport of the invention is any suitable applicator, for example, nozzle applicators, open-jet nozzle applicators ("Jet-Flow-F"), so-called SDTA applicators (short dwell time applicators), LDTA applicators (long dwell time applicators), applicators with an applicator chamber, and the like.

The inventors of the present invention have recognized that particular significance attaches, in view of the underlying technical problem, to the effect of the air boundary layer entrained by the backing roll surface and the material web side facing the backing roll. The inventional arrangement of the air boundary layer stripper can easily and effectively remove, deflect or bar the air boundary layer, entrained by both the backing roll and the material web side near the backing roll, before the material web runs at the tip of the entrance gore onto the backing roll surface. The apparatus according to the invention has also proved very effective at high material web speeds. The manipulation of the boundary layer occurs directly on those sides of the material web and the backing roll which are afflicted with the boundary layer, and which run after passage of the entrance gore tip onto one another. Therefore, a more efficient removal of the boundary layer is realizable with varying or specific material web properties, for example, with a rough surface structure, which entrains more air than a smooth structure. Coating defects or undesirable wrinkling at the point of application or on a metering or treatment element preceding or following the point of application, attributable to air inclusions, are minimized as compared to the prior art. The solution according to the invention guarantees a defined material web contact with the backing roll and contributes to increasing the achievable quality of the product made with the apparatus according to the invention.

A configuration feature of the invention provides for arranging the.air boundary layer stripper in the immediate vicinity of the entrance gore tip. The air boundary layer entrained by the backing roll surface, or the material web side near the backing roll, is removed directly before the material web runs at the entrance gore tip onto the backing roll surface. A new boundary layer is thus prevented from forming in the surface area substantially free of a boundary layer, and air inclusions attributable to the boundary layer, between backing roll surface and material web, are effectively avoided.

In another embodiment of the inventional apparatus, the air boundary layer stripper includes at least one suctioning system featuring at least one suction opening coordinated with the backing roll surface and/or the material web side near the backing roll. The suctioning system serves to suck off the air boundary layer entrained by the backing roll and/or the material web. Undesirable air inclusions caused by the boundary layer, between the backing roll surface and the side of the material web near the backing roll, are in this way effectively avoided.

In yet another embodiment, the air boundary layer stripper includes at least one blowing system ejecting at least one gaseous medium and having at least one discharge opening for the gaseous medium that is coordinated with the backing roll surface and/or the side of the material web near the backing roll. The discharge opening directs the flow of the discharging gaseous medium in a direction opposite to the direction of rotation of the backing roll on the backing roll surface and/or substantially opposite to the traveling direction of the material web on its side facing the backing roll. Thereby, the air boundary layer entrained by the backing roll surface and/or the material web side facing the backing roll is prevented from proceeding between the backing roll surface and the side of the material web near the backing roll. Air can be employed as the gaseous medium, but other gaseous mediums are also suitable, however, depending on certain operating parameters of the apparatus and certain effects to be achieved.

Another embodiment of the inventional apparatus again provides for the air boundary layer stripper to include at least one blowing system ejecting a gaseous medium and featuring at least one discharge opening for the gaseous medium. At least one deflecting element is coordinated with the discharge opening and deflects the flow of the issuing gaseous medium in a direction substantially opposite to the direction of rotation of the backing roll on the backing roll surface and/or substantially opposite to the traveling direction of the material web on its side near the backing roll. Thereby, the air boundary layer entrained by the backing roll surface and/or the material web side near the backing roll is prevented from proceeding between the backing roll surface and the side of the material web facing the backing roll. Possible as deflection elements in the purport of the invention, for example, are one or several baffles or deflection channels arranged before the discharge opening. The position of the baffles or deflection channels relative to the discharge opening and/or their geometry is adjustable, if needed, manually or automatically. According to another inventional variant of solution, the air boundary layer stripper includes at least one scraper system that features at least one scraper. element which is coordinated with the side of the material web near the backing roll surface and/or the backing roll. The at least one scraper element removes or deflects the air boundary layer entrained by the backing roll surface and/or the side of the material web facing the backing roll. The scraper element, or its free scraper edge, may be positioned a distance smaller than the boundary layer thickness from the backing roll surface and/or the side of the material web facing the backing roll. Alternatively, the arrangement of the scraper element may be such that it touches the backing roll surface and/or the side of the material web near the backing roll. Thus, the scraper element strips the air boundary layer away and prevents associated air inclusions from proceeding between the backing roll surface and the side of the material web facing the backing roll. Usable as scraper elements, e.g., are substantially rigid or elastically deformable blades and the like. Furthermore, the scraper system may include suitable adjustment and/or positioning systems as well as control and/or regulating systems for exact adjustment of the scraper element.

Lastly, the inventional apparatus can include at least one further air boundary layer stripper which, based on the direction of rotation of the backing roll, is arranged before the applicator and is coordinated with the side of the material web away from the backing roll. This further air boundary layer stripper removes the air boundary layer entrained by the far material web side and may be a structure known as such, substantially as described in German Document No. DE 42 05 313 A1 or EP 0 556 675 A1, assigned to the assignee of the present invention. Also avoidable by this measure is an undesirable air inclusion on the side of the material web on which the liquid or pasty medium is applied, that is, on the side away from the backing roll. This is also conducive to increasing the achievable coating quality.

A method for direct or indirect application of a liquid or pasty medium onto a traveling material web, notably of paper or cardboard, which in part wraps around at least one rotatable backing roll supporting a material web side near the backing roll, the backing roll surface and the material web forming a cuneiformly tapering entrance gore and an exit gore, includes the following steps, but not mandatorily in the stated order:

removing an air boundary layer entrained by the backing roll and/or the material web at least at a point located in the entrance gore, in relation to the direction of rotation of the backing roll, before the point of coating application and between the backing roll surface and the material web side near the backing roll; and coating a side of the material web away from the backing roll with the medium and/or further treating the coated material web side. The two above steps can occur in the operation simultaneously. The air boundary layer strippers and applicators illustrated above in conjunction with the apparatus according to the invention can be employed for removal of the air boundary layer and for coating the material web. The inventional method offers the advantages already illustrated in detail in conjunction with the inventional apparatus.

According to another aspect of the inventional method, the air boundary layer is removed in the immediate vicinity of the tip of the entrance gore.

In another embodiment of the inventional method, the air boundary layer is removed by suctioning the side of the material web facing the backing roll and/or by suctioning the backing roll surface. Suctioning is performed by a suitable suctioning system, such as illustrated above, e.g., in conjunction with the inventional apparatus.

According to a further variant of the inventional method, which has also proved very effective, at least one gaseous medium, for example air or another suitable gas, is blown in a direction substantially opposite to the direction of rotation of the backing roll on the backing roll surface and/or substantially opposite to the traveling direction of the material web on the side of the latter near the backing roll. This prevents the air boundary layer entrained by the backing roll surface and the side of the material web near the backing roll from proceeding between the backing roll surface and the side of the material web facing the backing roll. Blowing is carried out by a suitable blowing system, such as illustrated, e.g., above in conjunction with the inventional apparatus.

In a further embodiment of the inventional method, in contrast, at least one gaseous medium is blown at at least one deflection element arranged at the point located in the entrance gore, The at least one deflection element directs the flow of discharging gaseous medium in a direction substantially opposite to the direction of rotation of the backing roll on the backing roll surface and/or substantially opposite to the traveling direction of the material web at its side facing the backing roll. In this way, too, the air boundary layer entrained by the backing roll surface and/or the material web side near the backing roll can be effectively prevented from entering between the backing roll surface and the side of the material web near the backing roll. Regarding design options of a suitable deflection element and of a corresponding blowing system, reference is made to the above explanations of the inventional apparatus.

According to still another variant of the inventional method, the air boundary layer entrained by the backing roll surface and/or the side of the material web near the backing roll is removed or deflected by scraping. As already indicated above, this may be effected with the aid of a suitable scraper element operating either with or without physically contacting the backing roll surface and/or the side of the material web near the backing roll.

The aforementioned steps of the method may be combined in the purport of the invention with an additional process step. According to the additional process step, the air boundary layer entrained by the side of the material web away from the backing roll is removed at another point located, in relation to the direction of rotation of the backing roll, before the point of coating application.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
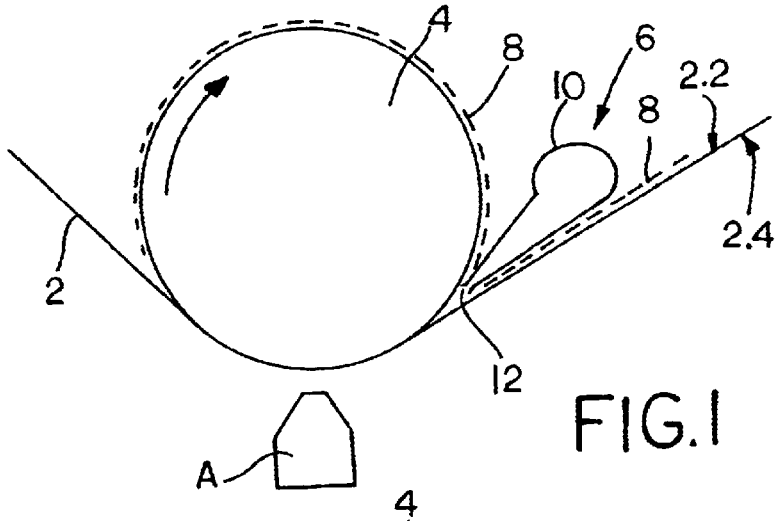
FIG. 1 is a schematic, cross-sectional illustration of a first embodiment of the inventional apparatus, in the area of an applicator, the drawing also illustrating the principle of a first variant of the inventional method.

Referring now to the drawings and particularly to FIG. 1, there is shown a schematic, cross-sectional illustration of a first embodiment of an inventional apparatus for direct application of a liquid or pasty medium onto a traveling material web 2, notably of paper or cardboard. The apparatus includes a rotatable backing roll 4 which in part is wrapped by material web 2 and which supports a side 2.2 of the material web 2 facing backing roll 4. The backing roll surface and material web 2 form a cuneiformly tapering entrance gore and an exit gore. The direction of rotation of backing roll 4 is indicated in the drawings by an arrow. Moreover, the apparatus includes an applicator A, indicated only schematically and opposing backing roll 4. Applicator A coats a side 2.4 of material web 2 away from backing roll 4 with the medium. A so-called open-jet nozzle applicator can be used as applicator A.

An air boundary layer stripper 6, for removal of a boundary layer 8 entrained by backing roll 4 and material web 2, is provided before applicator A, based on the direction of rotation of backing roll 4. Air boundary layer stripper 6 extends substantially across the entire machine width. The relevant boundary layers 8 are indicated in the drawing by dashed line. Air boundary layer stripper 6 is arranged in the entrance gore between the backing roll surface and the side 2.2 of material web 2 facing backing roll 4. Air boundary layer stripper 6 includes a suctioning system 10 positioned in the immediate vicinity of the tip of the entrance gore. Suctioning system 10 includes a suction opening 12 coordinated with both the backing roll surface and side 2.2 of material web 2 near backing roll 4. Suction opening 12 suctions off the air boundary layer 8 entrained by backing roll 4 and material web 2. The suctioning effect of air boundary layer stripper 6 removes air boundary layer 8 before material web 2 runs onto backing roll 4. Thus, air inclusions caused by the boundary layer entering between the backing roll surface and material web 2 are avoided. Hence, the removal of air boundary layer 8 and the application of the medium occur simultaneously after a start up phase of the apparatus, but in different sections of material web 2.

Figure 2:
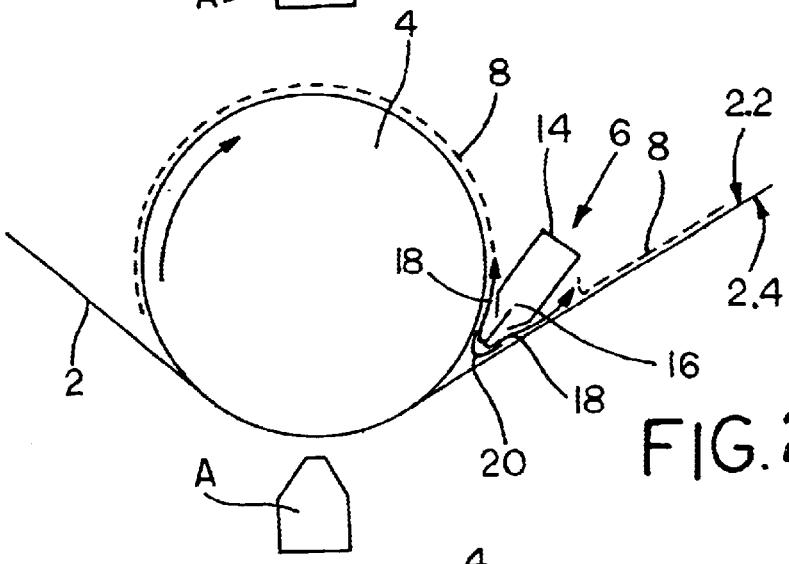
FIG. 2 is a schematic, cross-sectional illustration of a second embodiment of the inventional apparatus, in the area of an applicator, the drawing also illustrating the principle of a second variant of the inventional method.

FIG. 2 shows in a schematic, cross-sectional illustration a second embodiment of the inventional apparatus in the area of an applicator. The variant according to FIG. 2 corresponds essentially to that relative to FIG. 1. Instead of the aforementioned suctioning system 10, however, air boundary layer stripper 6 includes a blowing system 14 which discharges a gaseous medium 18, such as air. Blowing system 14 includes at least one discharge opening 16 for the air 18 and a cross-sectionally U-shaped deflection element 20 arranged in the entrance gore in front of discharge opening 16. The air 18 flowing out of discharge opening 16 impinges on deflection element 20 and is deflected by it. Air 18 flows away from deflection element 20 in a direction substantially opposite to the direction of rotation of backing roll 4 on the backing roll surface. Air 18 also flows away from deflection element 20 in a direction substantially opposite to the traveling direction of material web 2 on its side 2.2 facing backing roll 4. Thus, air 18 bars the respective air boundary layers 8 from the tip of the entrance gore. An undesirable entering of the air boundary layers 8, entrained by the backing roll surface and by material web side 2.2 near backing roll 4, in between the backing roll surface and side 2.2 of material web 2 is prevented thereby.

Figure 3:
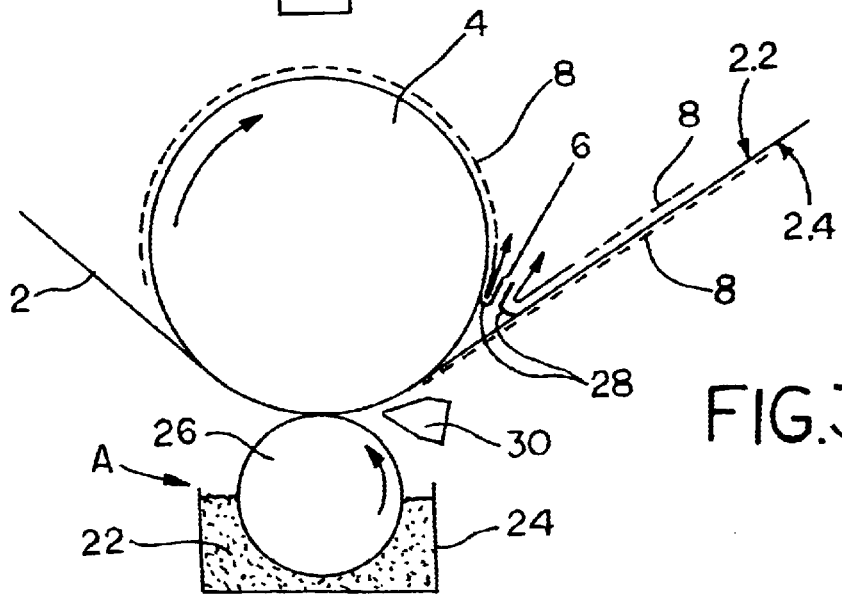
FIG. 3 is a schematic, cross-sectional illustration of a third embodiment of the inventional apparatus, in the area of an applicator, the drawing also illustrating also the principle of a third variant of the inventional method.

FIG. 3 shows in a schematic, cross-sectional illustration a third embodiment of the inventional apparatus, configured as an apparatus for indirect application of a liquid or pasty medium 22 onto traveling material web 2. The apparatus includes an applicator A having an applicator roll 26 opposing backing roll 4 and rotating in a bath 24 of liquid or pasty coating medium 22. Applicator roll 26 picks up medium 22 with its surface and transfers it to the side 2.4 of material web 2 away from backing roll 4. The transfer occurs in a nip formed between backing roll 4 and applicator roll 26 through which material web 2 passes.

In this embodiment, the air boundary layer stripper 6 includes a scraper system with two cross-sectionally hook-like scraper elements 28 which each extend substantially across the entire machine width. One of scraper elements 28 touches the surface of backing roll 4 and the other scraper element 28 touches the side 2.2 of material web 2 near backing roll 4. Thus, scraper elements 28 scrape off the air boundary layers 8 entrained by the backing roll surface and by material web side 2.2. As indicated by arrows, the stripped boundary layer 8 is, on account of the cross-sectionally hook-like configuration of scraper elements 28, deflected and removed in a direction which at this point is substantially opposite to the direction of rotation of backing roll 4 and the traveling direction of material web 2. Prevented thereby is an undesirable entering, between the backing roll surface and side 2.2 of material web 2, of the air boundary layer 8 entrained by the backing roll surface and by material web side 2.2 near backing roll 4.

Additionally, the apparatus according to FIG. 3 possesses a further air boundary layer stripper 30 which, relative to the direction of rotation of backing roll 4, is arranged before applicator A and coordinated with the side 2.4 of material web 2 away from backing roll 4. Air boundary layer stripper 30 removes the air boundary layer 8 entrained by material web side 2.4, that is, by the material web side being coated. Air boundary layer stripper 30 is presently a design as known from German Document No's., DE 42 05 313 A1 or EP 0 556 675 A1, assigned to the assignee of the present invention. Also possible, however, is the use of other suitable designs.

The invention is not limited to the above exemplary embodiments, which merely serve the general explanation of the basic idea of the invention. Rather, both the inventional apparatus and the inventional method may assume within the scope of protection embodiments other than those described above. Specifically, the apparatus and the method may possess features representing a combination composed of the relevant individual features. Instead of the backing roll, other backing systems (e.g., a revolving endless belt) may also be employed with the apparatus, provided that their backing surface(s) form together with material web 2 a cuneiformly tapering entrance gore. Instead of the air boundary layer strippers 6 described explicitly above, other air boundary layer strippers suited for the intended purpose may also be used.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for one of direct and indirect application of a coating medium onto a traveling fiber material web having a first side and a second side, said method comprising the steps of:

supporting the first side of the web with at least one rotatable backing roll such that the web wraps partly around said at least one rotatable backing roll, said at least one rotatable backing roll and the first side of the web defining a cuneiformly tapering entrance gore and an exit gore;

coating the second side of the web at a coating point with the coating medium by using at least one applicator opposing said at least one rotatable backing roll and configured for at least one of applying the coating medium onto the second side of the web and treating the second side of the web the second side of the web, said coating point opposing said at least one backing roll; and removing a first air boundary layer entrained by at least one of said at least one rotatable backing roll and the first side of the web, said removing step being performed at at least one removal point by at least one first air boundary stripper disposed and directed between said at least one rotatable backing roll and the first side of the web within said entrance gore, before said coating point.

2. The method of claim 1, wherein said at least one removal point is adjacent a tip of said entrance gore.

3. The method of claim 1, wherein said removing step includes suctioning off said first air boundary layer entrained by at least one of the first side of the web and said at least one rotatable backing roll.

4. The method of claim 1, comprising the further step of eliminating a second air boundary layer entrained by the second side of the web, said eliminating step occurring at an eliminating point disposed before said coating point relative to said direction of rotation of said at least one rotatable backing roll.

5. An apparatus for one of direct and indirect application of a coating medium onto a traveling fiber material web having a first side, a second side and a direction of travel, said apparatus comprising:

at least one rotatable backing roll having a direction of rotation, said at least one rotatable backing roll being configured to be wrapped in part by the web, to support the first side of the web, and to define, along with the first side of the web, a cuneiformly tapering entrance gore and an exit gore;

at least one applicator opposing said at least one backing roll, said at least one applicator configured for at least one of applying the coating medium onto the second side of the web and treating the second side of the web; and at least one first air boundary layer stripper disposed before said at least one applicator relative to said direction of rotation of said at least one rotatable backing roll, said at least one first air boundary layer stripper being configured to remove an air boundary layer entrained by at least one of said at least one backing roll and the first side of the web, said at least one first air boundary layer stripper being disposed between said at least one rotatable backing roll and the first side of the web in said entrance gore.

6. The apparatus of claim 5, wherein said entrance gore includes a tip, said at least one first air boundary layer stripper being disposed adjacent said tip.

7. The apparatus of claim 5, wherein said at least one first air boundary layer stripper includes at least one suctioning system having at least one suction opening associated with at least one of the first side of the web and said at least one rotating backing roll, said at least one suctioning system being configured to suction off said air boundary layer entrained by at least one of said at least one backing roll and the web.

8. An apparatus for one of direct and indirect application of a coating medium onto a traveling fiber material web having a first side, a second side and a direction of travel, said apparatus comprising:

at least one rotatable backing roll having a direction of rotation, said at least one rotatable backing roll being configured to be wrapped in part by the web, to support the first side of the web, and to define, along with the first side of the web, a cuneiformly tapering entrance gore and an exit gore;

at least one applicator opposing said at least one backing roll, said at least one applicator configured for at least one of applying the coating medium onto the second side of the web and treating the second side of the web;

at least one first air boundary layer stripper disposed before said at least one applicator relative to said direction of rotation of said at least one rotatable backing roll, said at least one first air boundary layer stripper being configured to remove an air boundary layer entrained by at least one of said at least one backing roll and the first side of the web, said at least one first air boundary layer stripper being disposed between said at least one rotatable backing roll and the first side of the web in said entrance gore; and at least one second air boundary layer stripper associated with the second side of the web and disposed before said at least one applicator relative to said direction of rotation of said at least one rotatable backing roll, said at least one second air boundary layer stripper being configured to remove an air boundary layer entrained by the second side of the web.

* * * * *